US005117784A

United States Patent [19]

Schechter et al.

[11] Patent Number: 5,117,784

[45] Date of Patent: Jun. 2, 1992

[54] INTERNAL COMBUSTION ENGINE CAMSHAFT PHASESHIFT CONTROL SYSTEM

[75] Inventors: Michael M. Schechter, Farmington Hills; Aladar O. Simko, Dearborn Heights, both of Mich.

[73] Assignee: Ford Motor Company, Dearborn, Mich.

[21] Appl. No.: 695,162

[22] Filed: May 3, 1991

[51] Int. Cl.[5] ..... F01L 1/34

[52] U.S. Cl. ..... 123/90.17; 123/90.31

[58] Field of Search ..... 123/90.12, 90.15, 90.17, 123/90.31; 464/2

[56] References Cited

U.S. PATENT DOCUMENTS

| | | | |
|---|---|---|---|
| 2,682,260 | 6/1954 | Lantz | 123/90 |
| 2,861,557 | 11/1958 | Stolte | 123/90 |
| 3,685,499 | 8/1972 | Meacham et al. | 123/90.15 |
| 3,721,220 | 3/1973 | Garcea | 123/90.15 |
| 3,945,355 | 3/1976 | Calviac | 123/90.18 |
| 4,231,330 | 11/1980 | Garcea | 123/90.15 |
| 4,421,074 | 12/1983 | Garcea et al. | 123/90.15 |
| 4,535,731 | 8/1985 | Banfi | 123/90.15 |
| 4,561,390 | 12/1985 | Nakamura et al. | 123/90.15 |
| 4,570,581 | 2/1986 | Titolo | 123/90.18 |
| 4,601,266 | 7/1986 | Oldfield et al. | 123/90.15 |
| 4,627,825 | 12/1986 | Bruss et al. | 464/2 |
| 4,762,097 | 8/1988 | Baker | 123/90.31 |
| 4,787,345 | 11/1988 | Thoma | 123/90.17 |
| 4,811,698 | 3/1989 | Akasaka et al. | 123/90.17 |
| 5,002,023 | 3/1991 | Butterfield et al. | 123/90.15 |

FOREIGN PATENT DOCUMENTS 2217812 11/1989 United Kingdom ..... 123/90.17

*Primary Examiner*—E. Rollins Cross
*Assistant Examiner*—Weilun Lo
*Attorney, Agent, or Firm*—Jerome R. Drouillard; Roger L. May

[57] ABSTRACT

A modular control mechanism for shifting the phase or angular position of a camshaft or camshafts relative to a crankshaft in an internal combustion engine, and utilizing the energy produced by the reaction torque pulses on the camshaft, and resultant pressure pulses in the cavities, to provide a self-actuating system. In one embodiment, e.g. for controlling a single camshaft, the mechanism comprises two hydraulic cylindrical housings attached to either the camshaft flange or the camshaft driving sprocket, and a respective piston within each cylindrical housing and attached to the other flange to form a rotational hydraulic coupling. The hydraulic cylinders provide a pair of fluid chambers varying in displacement as the two flanges are rotated relative to one another. A hydraulic control apparatus regulates the flow of fluid between the hydraulic cylinders, thus controlling the phase shift between the crankshaft and camshaft. In another embodiment, the two hydraulic cylindrical housings are replaced with a single housing including a double acting piston. The control mechanism of the foregoing embodiments being limited to controlling a single camshaft and utilizing a dual planetary gear set for controlling the degree of phase shift.

16 Claims, 5 Drawing Sheets

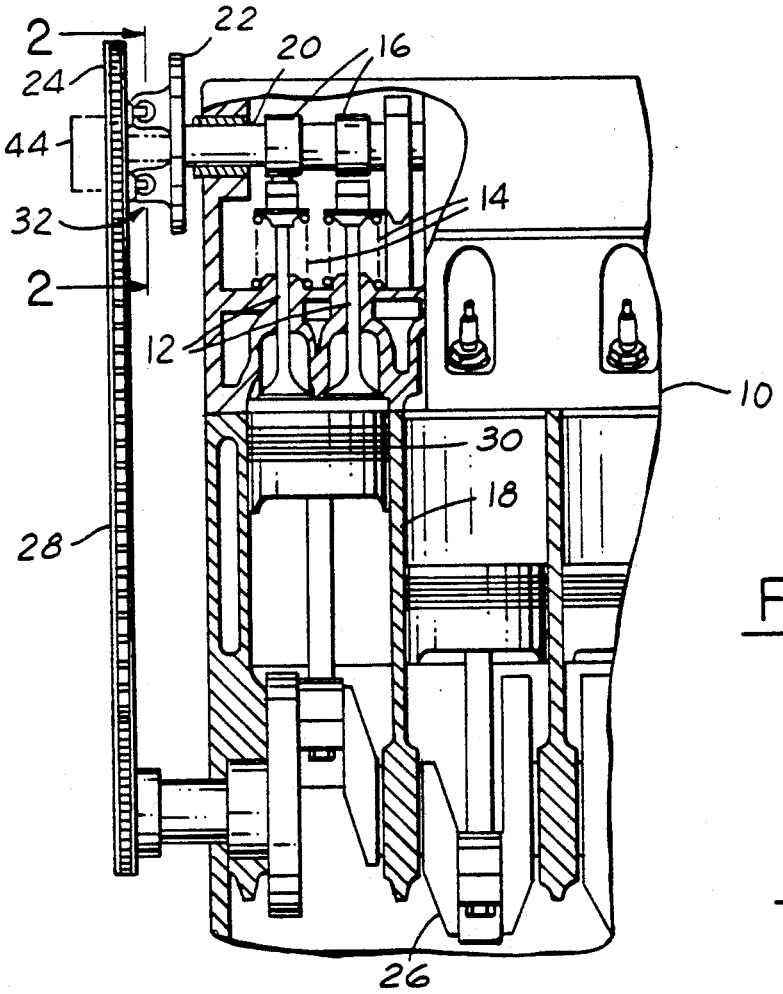
FIG. 1
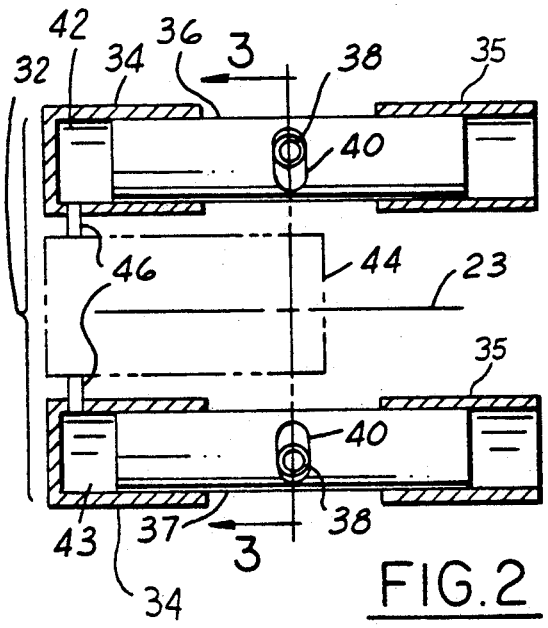
FIG. 2
FIG. 3
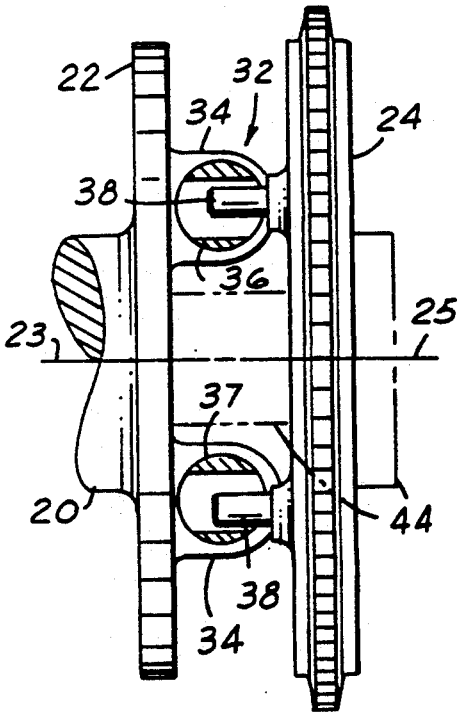

INTERNAL COMBUSTION ENGINE CAMSHAFT PHASESHIFT CONTROL SYSTEM

TECHNICAL FIELD

This invention relates to phase shifting in an internal combustion engine between the camshaft and crankshaft. More particularly, this invention relates to precise modular control of the timing of engine valves for various engine throttle speeds through the use of a rotational hydraulic coupling between the camshaft driving sprocket and the camshaft.

BACKGROUND ART

Traditionally, the timing between the camshaft and crankshaft are fixed for some predetermined optimum engine speed, but the timing will then be less than optimum at other engine speeds. Varying the timing between the camshaft and crankshaft by accurately modulating the phase shift, to ensure that it is optimized during engine operation, produces several benefits. It is common knowledge that adequate phase shifting will improve idle stability, the broadness of the torque curve and the RPM (revolutions per minutes) range of the engine. Additional benefits to be expected are (i) full control of emission gases and elimination of undesirable emissions [NOx], (ii) part load fuel efficiency improvements and (iii) elimination of external exhaust gas recirculation components and circuitry [EGR].

In developing a device to obtain these benefits, several important considerations are taken into account. The control system of the device should require low power consumption. Further, the response of the system must be fast and accurate to maximize these benefits Also, a system must be capable of being modulated incrementally throughout an entire range, as opposed to two position phase shifting, i.e., full advance or full retard only, to improve the overall effectiveness of the device.

Prior art, such as U.S. Pat. Nos. 3,685,499 and 3,721,220, have incorporated hydraulic means to accomplish phase shifts between the camshaft and crankshaft to achieve some of these benefits.

In U.S. Pat. No. 3,685,499, to Meacham et al, the phase shifting device is a helical ball spline mechanism. A driven member is fixed to the camshaft and connected by a helical ball spline to a piston which is rotatably fixed relative to the crankshaft. The inner and outer races of the ball spline form an enclosed cavity for hydraulic fluid. This is not a closed system since the flow of fluid into or out of the cavity, to obtain the phase shift, comes from outside the system, i.e. the primary engine oil source, and is continuous throughout the phase shift. Further, it requires the engine oil pressure as the source of energy for effecting the phase shift.

In U.S. Pat. No. 3,721,220 to Garcea, this is shown in a phase shifting device consisting of a drive and driven flange with a pair of hydraulic cylinders which rotate the flanges relative to one another. These cylinders, however, are much different than the present invention. The cylinders are not interconnected and both work in parallel, to accomplish a phase shift, when shifted outward by engine oil pressure.

Where the engine is equipped with independent intake and exhaust valve camshafts, it is also desirable that there be provided a system for independently being able to adjust the rotational position of the one such camshaft relative to the other and each relative to the engine crankshaft. This concept has not been put into use nor is any such system known to the inventors of the subject application.

SUMMARY OF INVENTION

The present invention, on the other hand, does not require the structured complexity of a helical ball spline arrangement.

Additionally, the present invention is in effect a closed system and utilizes pressure induced by the reaction torque pulses in a closed fluid system to accomplish the phase shift.

Further, in the present invention, the hydraulic cylinders work in opposition to one another and are interconnected, thus producing a balanced rotational coupling.

The present invention incorporates these considerations in order to produce a device which will deliver the benefits of optimized engine performance.

The present invention provides for modulated phase shifting, rather than a two position, i.e., full advance/-full retard phase system.

Additionally, the present invention requires low power consumption since the system takes advantage of reaction torque pulses induced by the valve return springs, which are already produced on the camshaft by the engine, as the energy source to retard or advance the camshaft relative to the crankshaft. The phase shifting accomplished by these torque pulses allows for fast response since each cylinder produces one retard and one advance pulse for every 720° of rotation.

The present invention provides a device for modular varying of the timing of a camshaft relative to the crankshaft, thus varying the timing of the engine valve actuation during engine operation. This is accomplished through a lower power consumption technique of self-actuating phase shift wherein the overall engine performance is improved by this phase shifting.

The present invention in another embodiment also provides a device for modular varying of the timing of an exhaust valve camshaft and an intake valve camshaft independently of one another and relative to the engine crankshaft, doing so with a single, integrating phase shifting control mechanism occupying minimal space within the engine compartment.

In accordance with one embodiment of the present invention, the phase shifting device operates on a single camshaft, e.g., the intake valve camshaft, and consists of a hydraulic mechanism incorporated between the camshaft driving sprocket and the camshaft itself. The two are rotationally coupled by a pair of hydraulic cylinders, with corresponding plungers or pistons, the two providing a pair of cavities which vary in displacement when the camshaft rotates relative to the camshaft driving sprocket. This allows for rotational phase shifting between the camshaft and crankshaft.

A control mechanism, positioned between the hydraulic cylinders, along a conduit which interconnects them, regulates the flow of oil between the oil cavities within the two cylinders, thus regulating the phase shift. The control mechanism alternatively prevents any flow of fluid between the two cavities, allows fluid to flow one way causing the camshaft to advance, or allows fluid to flow only the other way causing camshaft retard.

The control mechanism includes a pair of one-way acting, normally closed valves, each allowing fluid flow to a respective hydraulic cylinder when activated to an open position by a single common control cam.

The control mechanism also includes a dual planetary gear set having a common carrier for incrementally rotating the control cam whereby the ring gear of one set remains fixed while the ring gear of the second planetary gear set may be rotated in either direction to increase or decrease the phase angle of the camshaft relative to the crankshaft. Rotation of the ring gear rotates the control cam which is part of the second planetary gear set.

In a second embodiment of the present invention, the phase shifting device operates on both the intake valve camshaft and the exhaust valve camshaft, independently of one another, and each relative to the position of the crankshaft. As with the first embodiment, two hydraulic cylinders, each with a corresponding plunger or piston, are utilized as part of the hydraulic mechanism incorporated between the respective camshaft driving sprockets and the camshafts themselves. However, each hydraulic cylinder is double-acting such that one such cylinder can both advance and retard one camshaft, e.g., the intake valve camshaft, while the other hydraulic cylinder can both advance and retard the other camshaft, e.g., the exhaust valve camshaft.

In this second embodiment, one control cam is provided for each hydraulic cylinder. Further, there is provided a triple planetary gear set, again having a common carrier, wherein the first and second gear sets perform as in the first embodiment and the third gear set includes a ring gear under control which is separate from the control of the ring gear of the second set which may be rotated in either direction to increase or decrease the phase angle of the camshaft being controlled relative to the crankshaft. Rotation of either ring gear in the second and third sets causes rotation of a respective control cam.

The present invention uses the reaction torque pulses, induced by the valve return springs, as the energy for accomplishing the fluid flow between cavities of the hydraulic cylinders and the resultant phase shifting, which allows the system to be self-actuating with low power consumption, since no external hydraulic power is necessary to rotate the coupling, i.e., a camshaft relative to the crankshaft.

Further, each control mechanism allows for modular phase shifting with position feedback, or electrical digital feedback, to accurately control the amount of phase shift produced.

Other features and advantages of the present invention will become apparent from the following, more detailed description, taken in conjunction with the accompanying drawings.

BRIEF DESCRIPTION OF DRAWINGS

FIG. 1 is a partial cross sectional view showing a partial view of the side of a reciprocating internal combustion engine, incorporating the present invention;

FIG. 2 is an enlarged cross sectional view taken along line 2—2 of FIG. 1;

FIG. 3 is a cross sectional view taken along line 3—3 of FIG. 2;

BEST MODE FOR CARRYING OUT THE INVENTION

Figure 4:
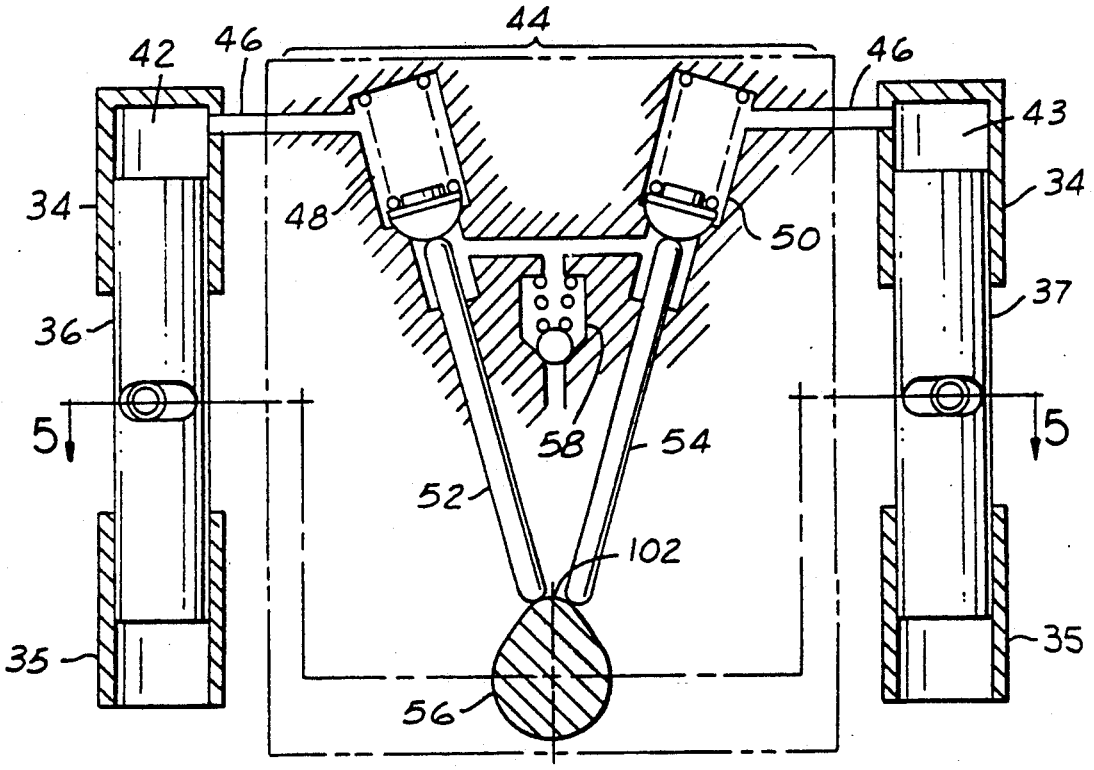
FIG. 4 is a view similar to FIG. 2, and schematically showing one embodiment the phase shift control mechanism of the present invention.

FIG. 1 shows a conventional reciprocating internal combustion engine block 10, with intake and exhaust valves 12 held against cam lobes 16 by the valve springs 14. The cam lobes 16 are integral with a camshaft 20, which in turn is integrally connected to the camshaft flange 22. Flange 22 is rotationally coupled to a camshaft drive sprocket 24 which in turn is coupled to the crankshaft 26 by a timing chain or belt 28. The axis of rotation 23 of the camshaft 20 coincides with the axis of rotation 25 of the camshaft drive sprocket 24. This assembly sets the timing of the engine valve actuation relative to the piston 30 motion or position during engine operation. The present invention controls the phase shifting of the camshaft 20 relative to the crankshaft 26 during engine operation by means of a hydraulic device 32 which rotationally couples a drive flange, namely, camshaft drive sprocket 24, to a driven flange, namely, the camshaft flange 22.

FIGS. 2-3 illustrate the rotational coupling of the hydraulic device 32. The coupling is positioned between the camshaft flange 22 and the camshaft drive sprocket 24 and includes two cylindrical housings 34. The cylindrical housings 34 are spaced from the central axis 23 and lie in a plane generally perpendicular thereto. Reciprocable pistons or plunger 36, 37 reside inside a respective cylindrical housing 34 to cooperate with the cylindrical housings 34 which are rigidly connected to the camshaft flange 22. This arrangement provides a pair of cavities 42 and 43, respectively, at one end of each plunger 36, 37. The opposite end of each plunger is supported in an axially aligned open ended cylinder 35. Two pins 38 are rigidly attached to the camshaft drive sprocket 24, and one each is coupled to respective moveable plungers 36, 37 by insertion of the pin 38 into plunger slot 40. The interconnected fluid cavities 42, 43 are filled with fluid and maintain a constant relative position of the cylindrical housings 34 to the moveable plungers 36, 37. Any one of several different hydraulic fluids will work, the most likely being oil. The fluid cavities are interconnected by a conduit 46. Interposed between the two oil cavities 42 and 43, along the conduit 46, is a control device 44.

The reverse of this assembly may also be arranged with cylindrical housings 34 rigidly attached to the camshaft drive sprocket 24 and the pins 38 rigidly attached to the camshaft flange 22.

Operatively, as long as the fluid volume in the interconnected oil cavities 42, 43 remains constant within each of them, the camshaft drive sprocket 24 rotationally drives the camshaft flange 22, without any phase change in the timing between the camshaft 20 and the crankshaft 26. Alternatively, as fluid is transferred from one cavity 42 or 43 to the other, the drive sprocket 24 will rotate relative to the camshaft flange 22. The control device 44 regulates the flow of oil between the two oil cavities 42, 43. As the control device 44 allows oil to flow from one oil cavity 42 or 43 to the other oil cavity, the plungers 36 slide within the cylindrical housings 34, thus causing the camshaft drive sprocket 24 to rotate relative to the camshaft flange 22, thereby causing a phase shift between the camshaft 20 and the crankshaft 26.

Figure 5:
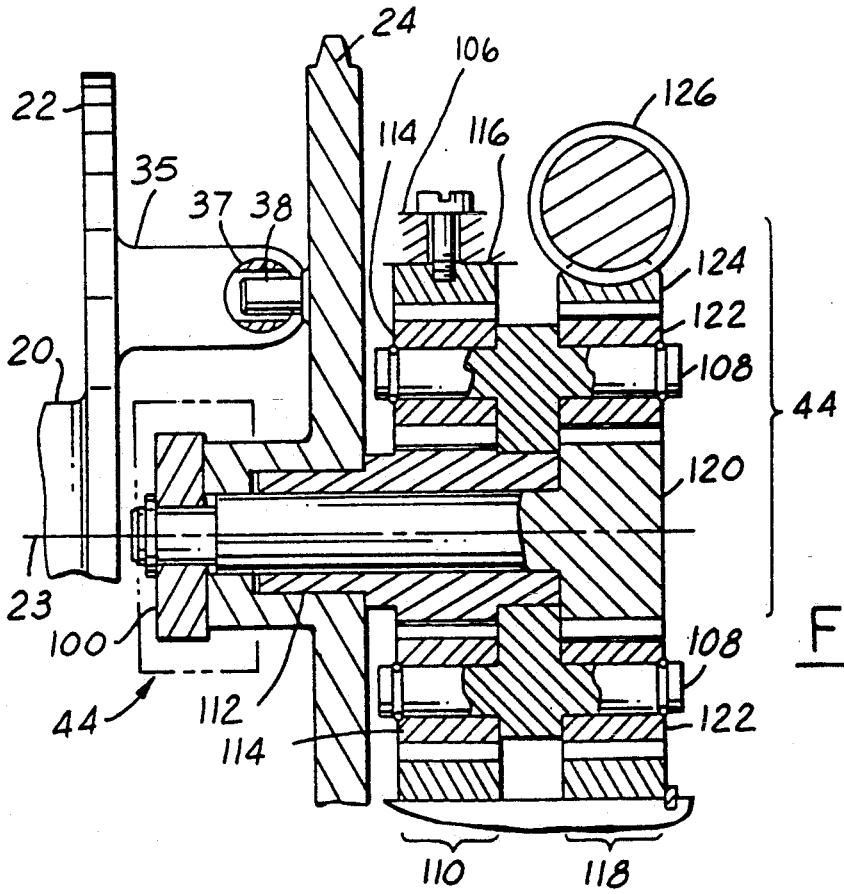
FIG. 5 is a cross sectional view taken along lines 5—5 of FIG. 4 rotated 90° counterclockwise.

The control device 44 to regulate the flow of oil from one oil cavity 42 or 43 to the other oil cavity, thus causing the phase shift, is shown in FIGS. 4 and 5. The oil cavities 42 and 43 are connected by way of conduit 46 to the control device 44, which regulates the flow of oil between the oil cavities 42 and 43. The control device 44 consists of two selectively activatable oppositely directed ball check valves 48 and 50, each engaged by a respective push rod 52, 54, interposed between the ball check valves 48 and 50, and a centrally located control cam 56. An oil makeup valve 58 is installed between the ball valves 48 and 50 to occasionally replenish from a main source any oil which may be lost internally within the system. The ball check valves 48 and 50 and oil makeup valve 58 are rigidly coupled to the camshaft flange 22 and rotate with it along with the cylindrical housings 34.

In operation, when push rods 52 and 54 are not activated, the ball check valves 48 and 50 remain closed and fluid cannot flow between the fluid cavities 42 and 43. Consequently, no phase shift can take place. When one of the push rods 52 or 54 is lifted, fluid flow, in one direction, can take place between fluid cavities 42 and 43, and phase shifts can occur. Lifting one push rod will allow fluid to flow one way causing a camshaft advance, and alternatively lifting the other allows fluid to flow the other way causing camshaft retard. The control device 44 takes advantage of the reaction torque pulses on the camshaft 20, which will produce a corresponding pressure pulse in the fluid cavities 42 and 43, thus no external hydraulic power is necessary to cause fluid to flow and rotate the coupling. Specifically, if push rod 52 was activated and held ball check valve 48 open, a pressure pulse in fluid cavity 42 will push ball check valve 50 open by hydraulic pressure, and fluid will flow from fluid cavity 42 into fluid cavity 43, thereby causing the plungers 36, 37 to slide in opposite direction thereby pushing on pins 38 and consequently rotating driven flange 22. This then results in the camshaft 20 advancing relative to the crankshaft 26. If, conversely, a pressure pulse is created in fluid cavity 43 while ball check valve 48 is open, then no fluid would flow since ball check valve 50 would remain closed. Fluid flow in the opposite direction, on the other hand, can be achieved when push rod 54 is activated. The fluid can then flow in the opposite direction in the same manner as described above. This fluid flow, from fluid cavity 43 to fluid cavity 42, would then cause the camshaft 20 to retard relative to the crankshaft 26.

Activation of the push rods is accomplished through the centrally located control cam 56.

The rotation of the control cam 56 relative to the camshaft drive sprocket 24 is accomplished through the use of two sets of substantially coaxial identical planetary gear sets 110, 118 rotationally coupled by a common carrier 108, located in the stationary housing 106, as shown in FIG. 5. The planetary gear sets 110, 118 have a central axis coincident with the camshaft central axis 23. The first planetary gear set 110 consists of sun gear 112 rigidly attached to the camshaft drive sprocket 24, at least two planet gears 114, and a stationary ring gear 116. The second planetary gear set 118 consists of a sun gear 120 rigidly attached to the control cam 56, at least two planet gears 122, and a ring gear 124. The planet gears 114 and 122 have a common carrier 108 on which the planet gears 114 and 122 are rotatably mounted. The outer surface of ring gear 124 forms a worm gear engaged with a worm 126, which can be driven by an external power source. The worm gear is self locking, so the worm 126 can drive the ring gear 124, but the ring gear 124 cannot drive the worm 126.

The cam 56 normally rotates with the same angular velocity as the camshaft drive sprocket 24, so the push rods 52 and 54 straddle the point of maximum lift, namely the cam lobe 102 shown in FIG. 4. The cam 56 is phase shiftable relative to the camshaft drive sprocket 24 in order to push one of the push rods 52, 54 up on to the cam lobe 102 and thereby activate the corresponding ball check valve 48, 50 respectively.

In operation, as long as both the ring gears 116 and 124 remain stationery, the sun gear 120, with cam 56, rotates with the same angular velocity as the sun gear 112, with the camshaft drive sprocket 24. Thus, no phase shift will occur. To effect a phase shift the worm gear 126 is rotated by an external power source, causing rotation of the ring gear 124. As a result, the sun gear 120 and fixed cam 56 will be caused to rotate relative to the sun gear 112 and fixed camshaft drive sprocket 24. This in turn results in push rod 52 or 54 activation and phase shift of the camshaft drive sprocket 24 relative to the camshaft 22, in the manner previously described, until the push rods 52 or 54 again straddle the cam lobe 102.

This embodiment allows for position feedback control. That is, when one of the ball check valves 48 or 50 is activated, a pressure pulse, as caused by the reaction torque pulses induced by the valve return springs, in the proper fluid cavity 42 or 43 will cause the fluid to flow from that chamber to the other. The resulting phase shift between the camshaft flange 22, which the check valves 48 and 50 are rigidly attached to, and the camshaft drive sprocket 24, which the cam 100 is rotationally coupled to, results in a rotation of the push rods 52 and 54 relative to the cam 100 until the push rods 52 and 54 again straddle the cam lobe 102, thereby deactivating the ball check valves 48 and 50 and terminating the phase shift.

Figure 4A:
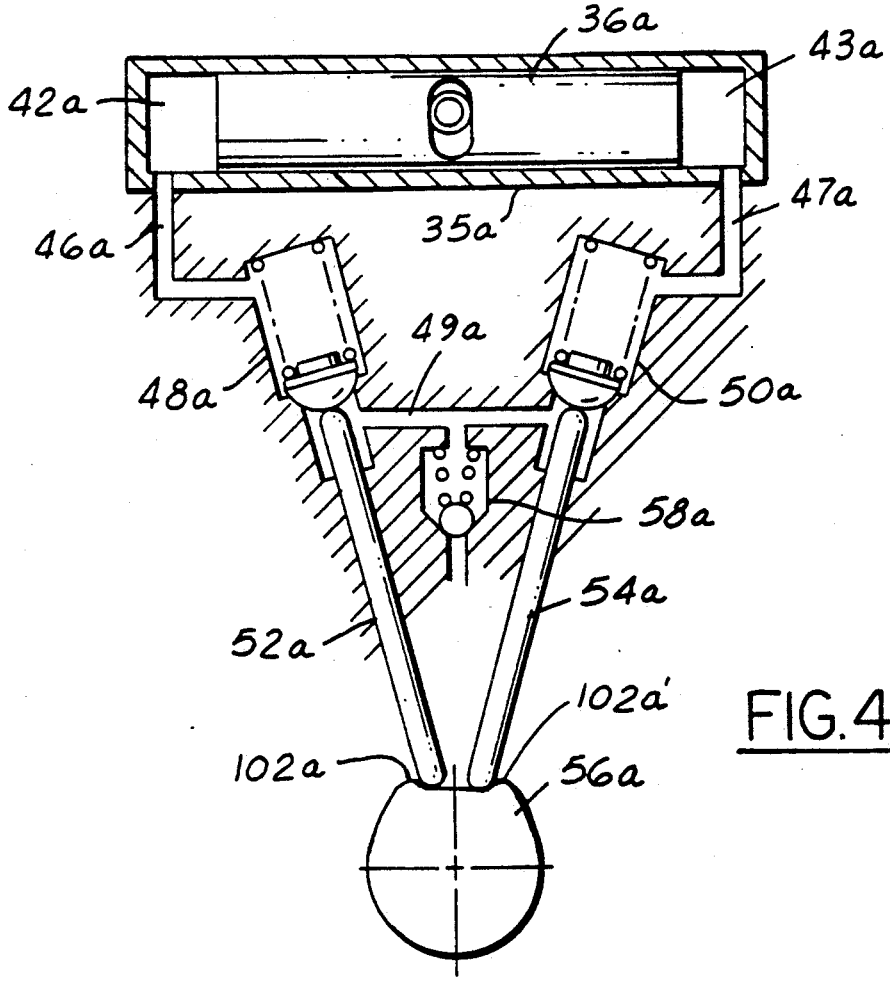
FIG. 4a is a view similar to FIG. 4 and shows an alternative embodiment of the phase shift control mechanism utilizing a single cylinder and double-acting piston in accordance with the present invention.

Instead of using two single acting hydraulic cylinders as shown in FIGS. 2-5, the control of the camshaft phase shift can also be performed by means of a single cylinder having a double-acting piston and an inversely-shaped control cam. Such an arrangement is shown in FIG. 4*a* wherein like reference numerals are used throughout to designate like components. The arrangement is similar to that shown in FIG. 4 except for the modified shape of the control cam 56*a* to include two cam lobes 102*a* and 102*a'* and the fact that the passages 46*a* and 47*a* connect the control check valves 48*a* and 50*a*, respectively, with the chambers 42*a* and 43*a*, respectively, formed on both sides of the piston 36*a* in the double-acting cylinder 35*a*. As with the embodiment shown in FIGS. 2-5, the piston 36*a* is attached to the driving sprocket, while the cylinder 35*a* and above-described related valves and passages rotate with the camshaft. Turning the cam 56*a* clockwise causes cam lobe 102*a* to force push rod 52*a* upwardly opening the valve 48*a* and permitting oil to flow from the chamber 42*a* through the passages 46*a*, 49*a*, and 47*a* to the chamber 43*a*. This results in a clockwise phase shift of the camshaft. Turning the cam 56*a* counter-clockwise similarly opens the valve 54*a* and this results in a counter-clockwise phase-shift.

In FIGS. 6-10, there is shown another embodiment of the present invention wherein the phase angle between both the intake valve camshaft and the exhaust valve camshaft can be independently controlled and adjusted relative to the crankshaft. As with the first embodiment shown in FIGS. 1-5, the phase shifting system, generally designated 198, includes a rotational coupling, generally designated 200, which is enclosed within a housing 202 having a camshaft drive sprocket 204 at its outer periphery, analogous to the camshaft drive sprocket 24 of the first embodiment. This in turn is coupled to a crankshaft by a timing chain or belt as previously mentioned. A phase-shifting mechanism or control mechanism, generally designated 400, is coaxially associated with the rotational coupling 200 for adjusting the phase angle essentially between the camshaft drive sprocket 204 and the several camshafts, i.e., the exhaust valve camshaft 208 and the intake valve camshaft as driven by a sprocket 210.

Figure 7:
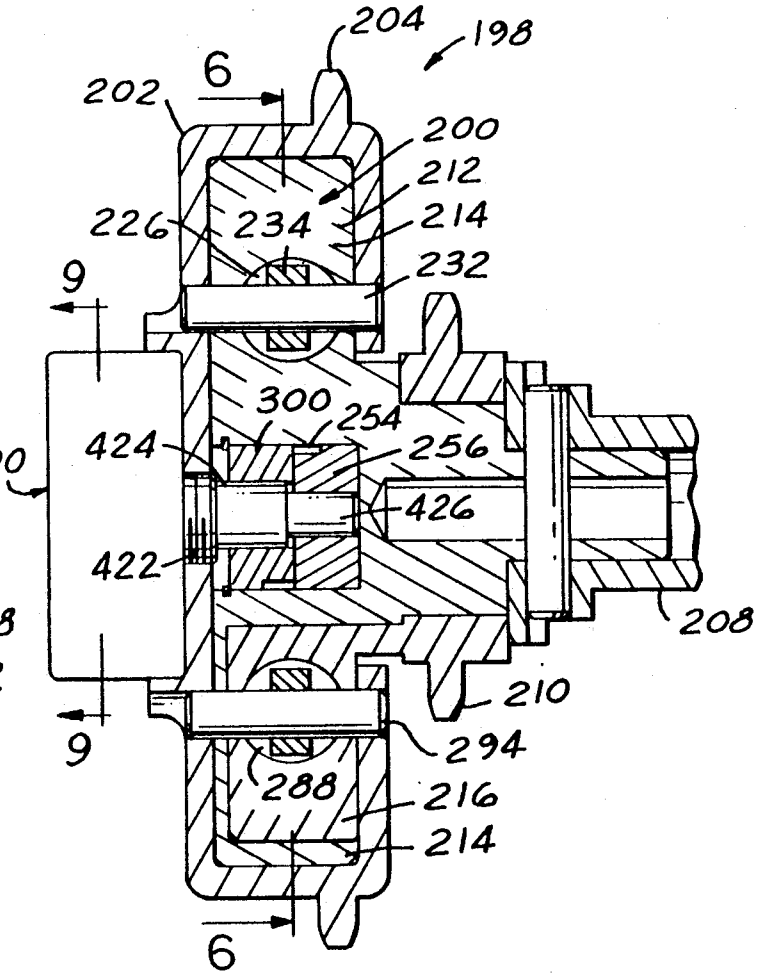
FIG. 7 is an elevation view shown in partial cross-section as taken along the lines 7—7 of FIG. 6.
Figure 6:
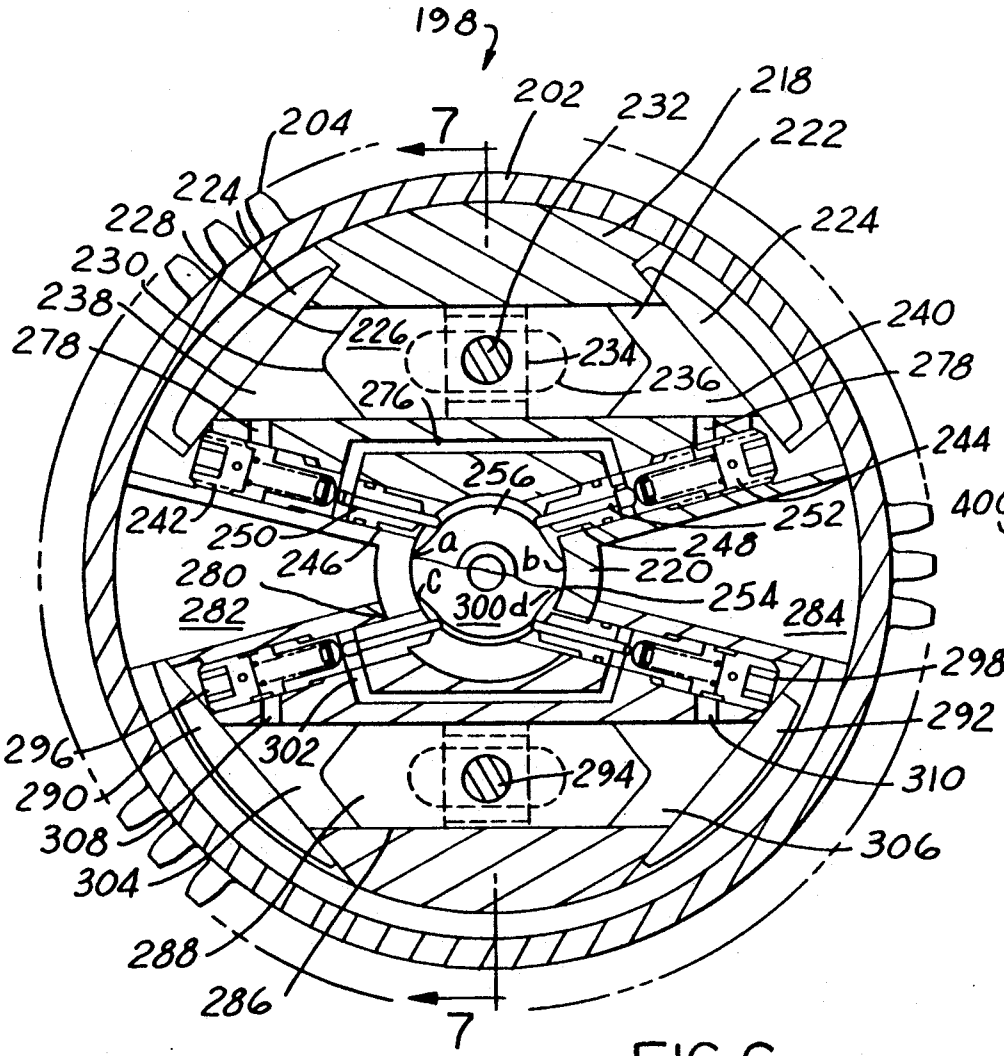
FIG. 6 is a front view in cross-section and showing an alternative embodiment of the phase-shifting mechanism of the present invention as taken along lines 6—6 of FIG. 7.

As seen particularly in FIGS. 6 and 7, the rotational coupling 200 internally of the housing 202 includes a relatively rotational, coaxial, annular, driven member 212. The driven member 212 includes a first sector member 214 for housing the hydraulic controls for shifting the phase angle of the exhaust valve camshaft, and a second member 216 for housing the hydraulic controls for shifting the phase angle with the intake valve camshaft. The first sector member 214 includes a sector body portion 218 having an annular internal hub portion 220. Within the body portion 218 there is provided a cylindrical fluid chamber 222. The chamber is closed at both ends by a pair of shoes 224. Within the chamber 222, there is provided a cylindrical reciprocating piston 226 having a pair of end portions defined by respective radially inwardly converging end walls 228, 230, converging inwardly at an angle equalling that at which the shoes 224 are disposed, so as to maximize the distance allowed for reciprocation of the piston 226. Midway between the end portions, there is provided a transversely extending pin 232 received within a pin carrier 234 which is in turn fixed to the midpoint of the piston 226. The piston further includes a slot 236 extending longitudinally of the axis of the chamber 222 equal in length to the designed reciprocation of the piston within the chamber 222. The pin carrier 234 centrally locates the pin 232 within the piston slot 236 and assures maintaining the pin in a clearance relationship with the slot. The piston is sealed at both ends to preclude any hydraulic fluid within the end chambers 238 and 240 from escaping from the sector member 218 or from being transferred from one end to the other of the piston chamber 222.

The first sector body portion 218 further includes a pair of radially disposed check valve assemblies 242, 244. Each is radially disposed opposite the other and is fixed within a respective bore 246, 248 such that the respective actuating push rod 250, 252 of each will extend radially within the bore 254 of hub 220 in a manner allowing its engagement with a control cam 256, as earlier described.

Figure 8:
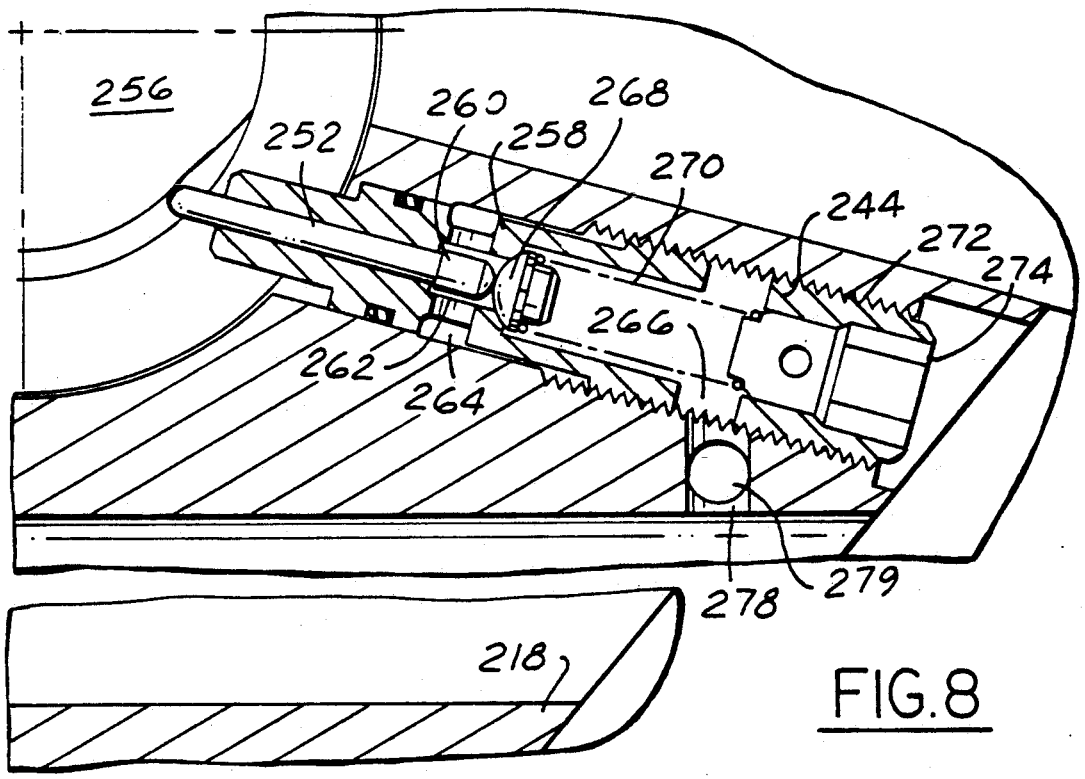
FIG. 8 is an expanded cross-sectional view of a portion of FIG. 6 showing a one-way, normally closed hydraulically actuated valve mechanism.

As seen particularly in FIG. 8, the actuating valve 244 is sealingly secured within bore 248 within the sector member body portion 218. The valve includes a cylindrical valve body 258 having a through bore at one end adapted to slidingly receive the push rod 252. The head 260 of the push rod lies within an internal fluid chamber 262. The valve body 244 includes hydraulic ports 264 and 266 at respective ends of the internal fluid chamber. Between the ports 264 and 266, there is provided a valve seat upon which rests a spring-loaded ball check valve 268 maintained in a normally closed position by a cylindrical coil spring 270. The valve is externally threaded at 272 and provided with a cap screw-type head 274 so that it can be adjustably threadedly engaged within the bore 248 at the proper position relative to the cam 256. The valve 242 is identical to valve 244.

Referring again to FIG. 6, it will be noted that the ports 264 of each valve body are connected to one another via conduit 276 and the ports 266 at the other end of each valve body communicate via conduits 278 with a respective fluid chamber 238, 240 on each side of the piston 226. Each conduit 278 also communicates through respective ports 279 with a low pressure hydraulic source, not shown, of makeup oil or other fluid to occasionally replenish from a main source any fluid which may be lost internally within the system.

The second sector member 216 of the driven member 212 is constructed similar to that of first sector member 214, with the exception that its radially innermost surface 280 is only partially circumferential and is adapted to be rotatably supported on the outer circumference of the hub 220 of member 214. Also, it will be seen from FIG. 7 that the first sector member is annular and contacts the housing 202 about is entire inner circumference and it rotatably receives the second sector member within an annular cavity occupying the entire lower half of the housing 202. In other words, the body portion 218 of first sector member 214 occupies the upper half of the housing 202 completely filling the housing across its full width as seen in FIG. 7. However, the lower half of first sector member 214 is cup-shaped as seen in FIG. 7 to receive the second sector member 216. The body portion 218 of first sector member 214 and the second sector member 216 each subscribe an arc of approximately 160° such that in between the ends of the two members, there is provided a free space as indicated at 282 and 284, allowing approximately 30° of rotational freedom of each member relative to the other to accommodate the phase angle shift in the manner described below.

The second sector member 216, as with the first sector member 214, includes a fluid chamber 286 having a piston 288 received therein and closed off at its ends by shoes 290, 292. The piston is secured in position by means of a pin 294 which extends transversely from the piston and is affixed to the housing 202 at both ends as shown in FIG. 7. Further, the second sector member 216 includes a pair of hydraulic control valves 296 and 298 identical in construction to valves 242, 244 previously described and engaging a second control cam 300 which is axially displaced from the first control cam as shown in FIG. 7. Each hydraulic control valve 296, 298 includes a pair of hydraulic ports with the ports nearest the respective push rod providing communication between the two valve mechanisms via a conduit 302, and with the second ports of each valve member communicating directly with a respective hydraulic end chamber 304, 306 via conduits 308 and 310, respectively.

Figure 10:
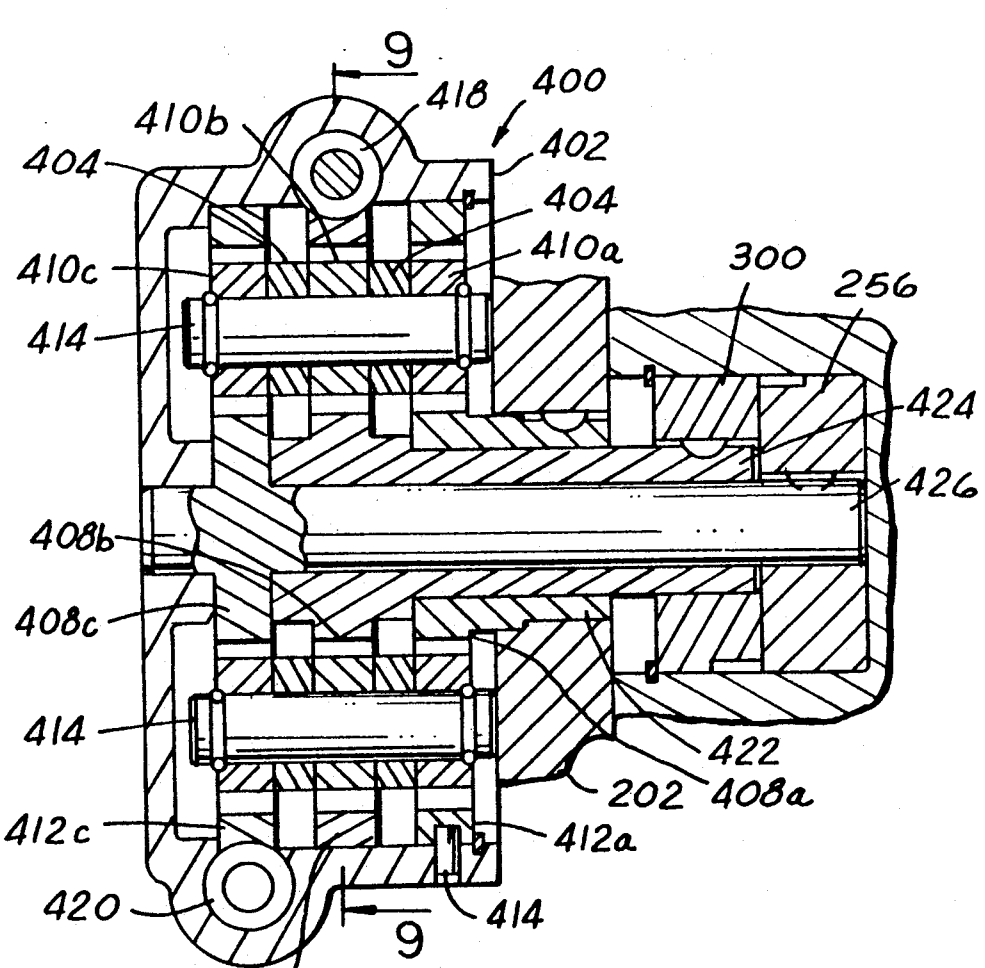
FIG. 10 is an elevation view shown in cross-section and taken along lines 10—10 of FIG. 9.
Figure 9:
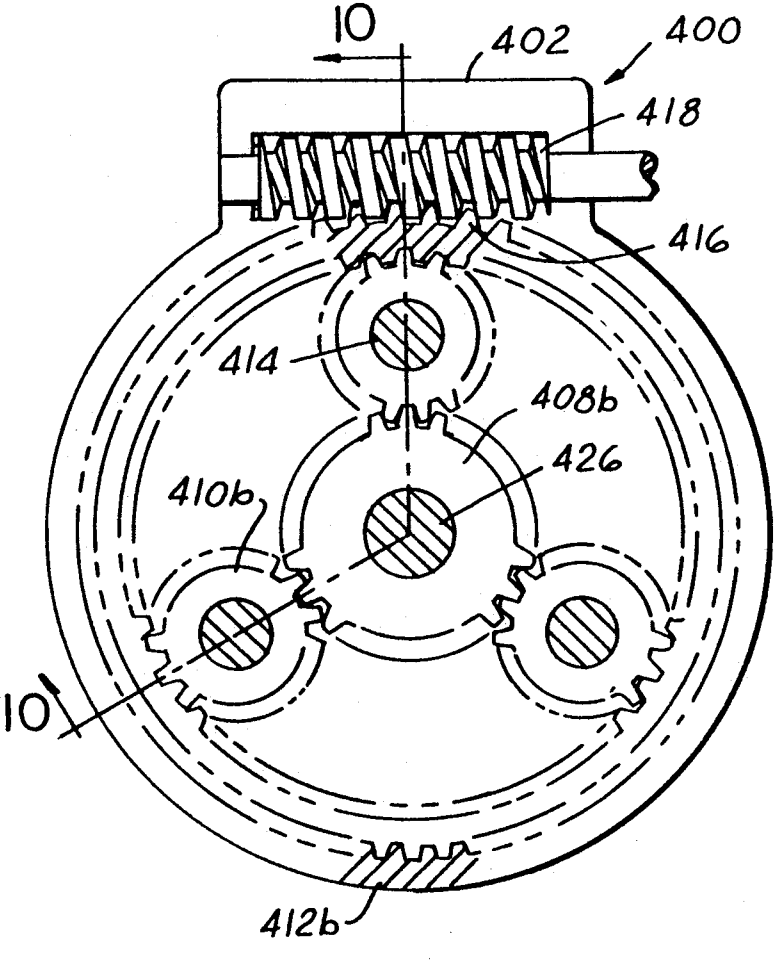
FIG. 9 is a front view shown in cross-section and partially schematic of the control mechanism shown in FIG. 7 and taken along the lines 9—9 of FIGS. 7 and 10.

The control mechanism or phaser 400 is shown in detail in FIGS. 9 and 10. The purpose of the control mechanism 206 is to perform a phase shift (relative rotation) of the cams 256 and 300 relative to the sprocket 204 during engine operation. The control mechanism includes a housing 402 which is held stationary. Inside the housing 402, there are three basically identical planetary gear sets with the planet gears in each set having a common carrier 404. Each set consists of a sun gear 408*a,b,c*, planet gears 410*a,b,c*, and a ring gear 412*a,b,c*. In the carrier 404, there are pins 414 upon which the planet gears are rotatably mounted. The planet gears 410*a* are engaged with the sun gear 408*a* and the ring gear 412*a*. The planet gears 410*b* are engaged with the sun gear 408*b* and the ring gear 412*b*. The planet gears 410*c* are engaged with the sun gear 408*c* and the ring gear 412*c*. A pin 414 prevents rotation of the ring gear 412*a*. The ring gears 412*b* and 412*c* have worm gearing teeth 416 about their outside peripheral surfaces and are engaged with worm gears 418 and 420, respectively. The helix in each of the worm gears is such that the engagement is self-locking and, therefore, the ring gears 412*b* and 412*c* cannot rotate unless the worm gears 418 and 420, respectively, are turned.

The sun gear 408*a* is engaged with the shaft 422 which is fixedly engaged with the driving sprocket 204. The sun gears 408*b* and 408*c* are integral with the shafts 424 and 426, respectively, which are fixedly engaged with the control cams 300 and 256, respectively, as shown in FIGS. 7 and 10.

As a result, the cams 256 and 300 rotate with the same velocity as the sprocket 204 and other rotating parts of the phase shifter. Turning the worm 420 causes rotation of the sun gear 408*c* relative to the other two sun gears and leads to phase shift of the exhaust valve cam 256 relative to the other rotating parts of the phase shifter. Similarly, turning the worm gear 418 leads to relative rotation of the sun gear 408*b* and a phase shift of the intake valve cam 300.

In operation, as with the first embodiment shown in FIGS. 1–5, the basic concept of the present invention is to take advantage of the fact that, during engine operation, each camshaft is subject to continuous series of two-directional reaction torque pulses. During each valve opening, the reaction torque is directed against the direction of each camshaft rotation, and during valve closing, it coincides with the direction of rotation. Each torque pulse generates a pressure pulse in one of the hydraulic chambers. During opening of an exhaust valve, a pressure pulse appears in the chamber 240, and during its closing pressure is generated in chamber 238. Opening of an intake valve generates pressure in the chamber 304, and during its closing a pressure pulse appears in the chamber 306.

The hydraulic system within the coupling 200, including the chambers 238, 240, 304 and 306 and the respective valves 242, 244, 296 and 298 are completely filled with oil. During operation, oil can flow from one of the two end chambers 238, 240 to another only if the normally closed valves 242 and 244 installed in the first sector member 214 are open. Similarly, oil can flow from one of the two end chambers 304, 306 to another only if the normally closed valves 296 and 298 installed in the second sector member 216 are open.

As long as the valves 242, 244, 296 and 298 remain closed, rotation of the driving sprocket 204 is transmitted to the driven member 212 through the trapped volumes of oil without any change in relative rotational position. Thus, there is no change in phase.

Opening of one of the valves 242, 244, 296 and 298 results in a phase-shift of one of the camshafts relative to the driving sprocket 204. For example, clockwise rotation of the cam 256 relative to the first sector member 214 lifts the push rod 250 on the cam lobe a and opens the check valve 242. Counter-clockwise rotation of the cam 256 causes push rod 252 to be lifted at cam lobe b and thus opens the corresponding check valve 268 in the valve 244. The cam 300 controls the valves 296 and 298 in a similar manner. Clockwise rotation of the cam 300 relative to the second sector member 216 opens the valve 298, while its counter-clockwise rotation opens the valve 296.

Specifically, as the cam 256 is turned clockwise (phase-shifted relative to the other rotating parts of the device), it opens the check valve in the valve 242. During each pressure pulse in the end chamber 238, oil flows from the end chamber 238 sequentially through internal passage 278, valve 242, passageway 276, valve 244 and passage 278 to the end chamber 240. Reverse flow of oil from the chamber 240 is prevented by the check valve 268 in the valve 244. As a result, the plunger 226 slides toward valve 242 and the first sector member 214 which carries the valves 242 and 244 is phase-shifted clockwise relative to the other rotating parts of the device. When the phase-shift of the first sector member 214 matches the previously performed phase-shift of the cam 256, the original relative position of the cam 256 and valves 242 and 244 is restored. The valve 242 closes, and this stops the flow of oil from the end chamber 238 to end chamber 240. Therefore, the phase-shift of the exhaust camshaft driving arm 214 always matches the phase-shift of the control cam 256. If the cam 256 is phase-shifted counter-clockwise, the valve 244 will open, oil will flow from end chamber 240 to end chamber 238 and the driving arm or first sector member 214 will copy the motion of the cam 256 in the counter-clockwise direction. Similarly, clockwise or counter-clockwise phase-shift of the cam 300 will cause opening of the valves 298 or 296, respectively, and a corresponding clockwise or counter-clockwise phase-shift of the second sector member 218 and integral intake camshaft driving sprocket 210. Thus, the exhaust and intake camshafts which are driven by the first sector member 214 and the second sector member 216, respectively, always repeat the motions of the cams 256 and 300, respectively. The phase-shift of any of the two camshafts is accomplished simply by turning a corresponding worm gear in the phaser 400 which can be performed by a stepper motor or other suitable device under the control of the engine electronic control system as part of an overall engine control strategy.

As with the first embodiment of FIGS. 1–5, the system shown in FIGS. 6–10 is substantially rotationally balanced. That is the collective mass moment of inertia is on the rotational axis of the phase-shifting system. This is the result, for example, of the rotational coupling 200 being constructed as two diametrically opposed sector members 214, 216 with each including reciprocating pistons 226, 228 of identical structure, equal mass, and being equally radially offset from the common rotational axis. All other rotational components of the rotational coupling have been constructed with the same criteria of rotational balance. Likewise, the control mechanism or phaser 400 is perfectly rotatively balanced due to the symmetry of the planetary gear sets.

Further, as with the first embodiment, the embodiment of FIGS. 6–10 allows for position feedback control in the same manner as earlier described.

The effort required to turn the worm gear in the phaser of either embodiment of the present invention is very low since the only resistance it meets is in the check valve it opens plus a neglible amount of friction. The hydraulic system of the phase-shifter amplifies this effort and provides sufficient force to phase-shift the camshaft.

It will also be noted that each phase shifter described above is inherently self-compensating for leakage. For example, in the last described embodiment, if unintentional shift begins to take place due to oil leakage from one side of the plungers 226 or 288 to another, a respective one of the control valves 242, 244, 296 and 298 will open, thereby causing the previous relative position of components to be restored in the manner earlier described.

While the best modes for carrying out the invention have been described in detail, those familiar with the art to which this invention relates will recognize alternative designs and embodiments for practicing the invention. Thus, the above described preferred embodiment is intended to be illustrative of the invention which may be modified within the scope of the following appended claims.

We claim:

1. In an internal combustion engine for varying the timing of at least one camshaft relative to a crankshaft, said system comprising:

a drive flange adapted to be coupled to the crankshaft for rotation about an axis;

a driven flange adapted to be coupled to said at least one camshaft for rotation about said axis;

a hydraulic coupling including a housing means connected to one of said flanges and a piston means cooperating with said housing means and connected to the other of said flanges, said housing means and piston means together defining a pair of fluid chambers adapted to be continuously filled with fluid, and interconnected by conduit means for transferring fluid from one said chamber to the other, the relative displacement of said fluid chambers varying as the drive and driven flanges rotate about said axis relative to one another causing said piston means to translate within said housing means, the fluid within said chambers having pressures which cyclically vary as a direct result of reaction torque imposed upon the camshaft as the camshaft rotates;

valve means for regulating the flow of fluid in the conduit means in response to a control signal to cause the drive and driven flanges to rotate relative to one another in a direction selected without any external power utilizing the cyclically varying fluid pressure within said fluid chambers;

said hydraulic system including means for independently varying the timing of an exhaust valve camshaft and an intake valve camshaft relative to a crankshaft;

said housing means comprising a pair of identically sized housing sections diametrically opposed from one another and equally radially spaced from said axis whereby said housing means is dynamically balanced relative to said one flange;

said piston means comprising a pair of identically sized pistons, one each being received within a respective one of said housing sections;

each of said pistons defining with a respective one of said cylindrical housings a respective one of said fluid chambers;

said fluid chambers being diametrically opposed relative to one another whereby said hydraulic coupling is dynamically balanced; and said housing sections being rotatable about said axis relative to one another and to said drive flange; and one said housing section being coupled to the exhaust valve camshaft and the other said housing section being coupled to said intake valve camshaft.

2. In an internal combustion engine, a hydraulic system for varying the timing of an intake valve camshaft and an exhaust valve camshaft relative to a crankshaft, said camshafts including a respective rotational axis, said system comprising:

a drive flange adapted to be rotatably coupled to a crankshaft for rotation about one said camshaft axis;

a driven flange coupled to said camshaft for rotation about said one camshaft axis;

a hydraulic coupling including a housing means connected to one of said flanges and a piston means cooperating with said housing means and connected to the other of said flanges, said housing means and piston means together defining a pair of fluid chambers adapted to be continuously filled with fluid, and interconnected by conduit means for transferring fluid from one said chamber to the other, the relative displacement of said fluid chambers varying as the drive and driven flanges rotate about said one camshaft axis relative to one another causing said piston means to translate within said housing means, the fluid within said chambers having pressures which cyclically vary as a direct result of reaction torque imposed upon the camshaft as the camshaft rotates;

valve means for regulating the flow of fluid in the conduit means in response to a control signal to cause the drive and driven flanges to rotate relative to one another in a direction selected without any external power utilizing the cyclically varying fluid pressure within said fluid chambers; and said hydraulic coupling and valve means on one of said exhaust and intake valve camshafts providing for independently varying the timing of the exhaust valve camshaft and the intake valve camshaft relative to a crankshaft.

3. The invention of claim 2 wherein said housing means comprises a first housing section and a second housing section, each housing section including a respective radially inwardly disposed hub portion, said hub portions being coaxially disposed relative to one another whereby one said hub portion is adapted to rotate about the other, and one said hub portion having an annular bore centered about said one camshaft axis, each said housing section including a main fluid chamber equally radially spaced from and transversely disposed relative to said one camshaft axis, said piston means including a piston disposed within each said main fluid chamber and defining said pair of fluid chambers within each said main fluid chamber at each end of said piston, said valve means including at least a single hydraulic valve within each housing section for regulating the flow of fluid to said pair of fluid chambers.

4. The invention of claim 2 wherein said housing means comprises a pair of identically sized housing sections diametrically opposed from one another and equally radially spaced from said axis whereby said housing means is dynamically balanced relative to said one flange, said piston means comprising a pair of identically sized pistons, one each being received within a respective one of said housing sections, each of said pistons defining with a respective one of said cylindrical housings a respective one of said fluid chambers, said fluid chambers being diametrically opposed relative to one another whereby said hydraulic coupling is dynamically balanced.

5. The invention of claim 3 wherein said housing sections are rotatable about said axis relative to one another and to said drive flange, one said housing section being coupled to the exhaust valve camshaft and the other said housing section being coupled to said intake valve camshaft.

6. The invention of claim 5 further including, control means for selectively actuating said valve means to cause said drive flange and said driven flange to rotate in either direction relative to one another whereby the timing may be selectively advanced or retarded.

7. The invention of claim 6 wherein said control means is coaxially disposed within said annular bore of said one hub portion.

8. The invention of claim 7 wherein said control means includes a pair of independently controlled cams rotatably coupled to said drive flange and having a cam lobe of maximum lift, said valve means comprising a pair of normally closed valves within each said housing section precluding transfer of fluid to a respective fluid chamber when closed and, when open, allowing transfer of fluid to a respective side of said piston and simultaneous release of an equal amount of fluid from the opposite side of said piston, said valve means being activated by said pair of independently controlled cams, and actuating means for independently rotating each of said cams in either direction thereby causing a different one of said pair of normally closed valves to open when said cam is rotated in either direction to thereby selectively advance or retard the timing of either said exhaust valve camshaft or said intake valve camshaft until said drive flange and said driven flange rotate sufficiently to cause said check valve to close thereby terminating said phase shaft.

9. The invention of claim 8 wherein said hydraulic system includes a first driven flange rotatably coupled to one said camshaft and a second driving flange rotatably coupled to the other said camshaft, said actuating means comprising a planetary gear set means having a pair of output members coaxially aligned and rotatably coupled with said drive flange, one of said cams being operatively coupled to a respective one of said output members and a rotatable input means adapted to be intermittently rotated in response to a control signal to effect a phase shift between said drive and either one of first and second driven flanges.

10. The invention of claim 9 wherein said planetary gear set means comprises first, second and third planetary gear sets coaxially aligned along a common axis, each set having a sun gear and a ring gear and a planet carrier;

one of said elements in the first set providing an input for cooperating with the crankshaft and a respective corresponding element in the second and third sets providing an output cooperating with the camshafts and constituting said output member, another one of said elements in the first set being affixed to the corresponding element in the second and third sets for rotation therewith; and a third element in one set being affixed to the engine and a corresponding element in each of the other sets constituting said output member and being adjustably fixed to the engine for a limited rotation about said axis to cause the timing of the camshafts and the crankshaft to vary.

11. The invention of claim 10 wherein said planetary gear set means comprises first, second and third substantially identical sets of coaxial planetary gear sets, each said planetary gear set including a sun gear, a ring gear, and at least two planet gears having a common planet gear carrier;

said sun gear of said first gear set being affixed to said drive flange and said sun gear of said second and third gear sets being affixed to a respective one of said cams;

said ring gear of said first gear set being rigidly fixed relative to the engine, said ring gear of said second and third gear sets being adapted to be rotatably mounted to a respective worm gear fixed relative to the engine block and rotatable by an external device responding to an input signal whereby independent rotation of each worm gear will cause rotation of the first gear set relative to a respective one of said second and third gear sets resulting in relative rotation of a respective one of said cams to said drive flange.

12. In an internal combustion engine for varying the timing of an intake valve camshaft and an exhaust valve camshaft relative to a crankshaft, said system comprising:

a drive flange adapted to be coupled to the crankshaft for rotation about an axis;

a driven flange adapted to be coupled to one said camshaft for rotation about said axis;

a hydraulic coupling including a housing means connected to one of said flanges and a piston means cooperating with said housing means and connected to the other of said flanges, said housing means and piston means together defining a pair of fluid chambers adapted to be continuously filled with fluid, and interconnected by conduit means for transferring fluid from one said chamber to the other, the relative displacement of said fluid chambers varying as the drive and driven flanges rotate about said axis relative to one another causing said piston means to translate within said housing means, the fluid within said chambers having pressures which cyclically vary as a direct result of reaction torque imposed upon the camshaft as the camshaft rotates;

valve means for regulating the flow of fluid in the conduit means in response to a control signal to cause the drive and driven flanges to rotate relative to one another in a direction selected without any external power utilizing the cyclically varying fluid pressure within said fluid chambers;

control means for selectively actuating said valve means to cause said drive flange and said driven flange to rotate in either direction relative to one another whereby the timing may be selectively advanced or retarded;

actuating means operatively coupled with said control means for independently varying the timing of the exhaust valve camshaft and the intake valve camshaft relative to the crankshaft;

said actuating means comprising a planetary gear set means having first, second and third substantially identical sets of coaxial planetary gear sets, each said planetary gear set including a sun gear, a ring gear, and at least two planet gears having a common planet gear carrier;

said sun gear of said first gear set being affixed to said drive flange and said sun gear of said second and third gear sets being operatively coupled to a respective one of said camshafts; and said ring gear of said first gear set being rigidly fixed relative to the engine, said ring gear of said second and third gear sets being adapted to be rotatably mounted to a respective worm gear fixed relative to the engine and rotatable by an external device responding to an input signal whereby independent rotation of each worm gear will cause rotation of the first gear set relative to a respective one of said second and third gear sets resulting in a relative rotation of a respective one of said camshafts.

13. In an internal combustion engine for varying the timing of at least one camshaft relative to a crankshaft, said system comprising:

a drive flange adapted to be coupled to the crankshaft for rotation about an axis;

a driven flange adapted to be coupled to said at least one camshaft for rotation about said axis;

a hydraulic coupling including a housing means connected to one of said flanges and a piston means cooperating with said housing means and connected to the other of said flanges, said housing means and piston means together defining a pair of fluid chambers adapted to be continuously filled with fluid, and interconnected by conduit means for transferring fluid from one said chamber to the other, the relative displacement of said fluid chambers varying as the drive and driven flanges rotate about said axis relative to one another causing said piston means to translate within said housing means, the fluid within said chambers having pressures which cyclically vary as a direct result of reaction torque imposed upon the camshaft as the camshaft rotates;

valve means for regulating the flow of fluid in the conduit means in response to a control signal to cause the drive and driven flanges to rotate relative to one another in a direction selected without any external power utilizing the cyclically varying fluid pressure within said fluid chambers;

said housing means comprising a pair of identically sized cylindrical housings diametrically opposed from one another and equally radially spaced from said axis whereby said housing means is dynamically balanced relative to said one flange;

said piston means comprising a pair of identically sized pistons, one each being received within a respective one of said cylindrical housings;

each of said pistons defining with a respective one of said cylindrical housings a respective one of said fluid chambers;

said fluid chambers being diametrically opposed relative to one another whereby said hydraulic coupling is dynamically balanced;

said valve means comprising first and second normally closed valves within said conduit means and precluding the transfer of fluid from one said fluid chamber to the other;

control means for selectively actuating to an open position each of said valves, whereby actuating one said valve allows fluid to transfer in one direction between said fluid chambers expanding one said chamber and contracting the other thereby causing said driven flange to be rotated in one direction to advance the camshaft relative to the crankshaft, and whereby actuating the other said valve allows fluid to transfer in an opposite direction between said fluid chambers contracting said one chamber and expanding said other chamber thereby causing said driven flange to be rotated in the other direction to retard the camshaft relative to the crankshaft;

said valve means further including a pair of reciprocable push rods, each push rod being disposed in coaxial alignment with a respective one of said valves at the inlet end of each said valve, one end of each said push rod engaging a respective one of said first and second valves, the other end of each said push rod being in engagement with said control means; and said control means comprising a cam rotatably coupled to said drive flange and having a cam lobe of maximum lift, said push rods straddling said cam lobe, actuating means for rotating said cam in both directions thereby causing one of said push rods to open one of said check valves when said cam is rotated in either direction, whereby both said check valves will be caused to open to allow fluid to transfer in one direction only from one of said fluid chambers to the other until said drive flange and said driven flange rotate sufficiently to cause both said push rods to again straddle said cam lobe, thereby closing off said check valves and terminating the phase shift.

14. The invention of claim 13 wherein said actuating means comprises a planetary gear set means having an output member coaxially aligned and rotatably coupled with said drive flange, said cam being operatively coupled to said output member and a rotatable input member adapted to be intermittently rotated in response to a control signal to effect a phase shift between said drive and driven flanges.

15. The invention of claim 14 wherein said planetary gear set means comprises first and second planetary gear sets coaxially aligned along a common axis, each set having three elements, a sun gear, a ring gear and a planet carrier;

one of said elements in the first set providing an input for cooperating with the crankshaft and a corresponding element in the second set providing an output cooperating with the camshaft and constituting said output member, another one of said elements in the first set being affixed to the corresponding element in the second set for rotation therewith; and a third element in one set being affixed to the engine and a corresponding element in the other set constituting said output member and being adjustably fixed to the engine for a limited rotation about the axis to cause the timing of the camshaft and the crankshaft to vary.

16. The invention of claim 14 wherein said planetary gear set means comprises first and second substantially identical sets of coaxial planetary gear sets, each said planetary gear set including a sun gear, a ring gear, and at least two planet gears having a common planet gear carrier;

said sun gear of said first gear set being affixed to said drive flange and said sun gear of said second gear set being affixed to said cam;

said ring gear of said first gear set being rigidly fixed relative to the engine, said ring gear of said second gear set being adapted to be rotatably mounted to a worm gear fixed relative to the engine block and rotatable by an external device responding to an input signal whereby rotation of the worm gear will cause rotation of the first gear set relative to the second gear set resulting in relative rotation of said cam to said drive flange.

* * * * *